US006954032B2

(12) United States Patent
Chiba

(10) Patent No.: US 6,954,032 B2
(45) Date of Patent: Oct. 11, 2005

(54) DISCHARGE LAMP OF THE SHORT ARC TYPE

(75) Inventor: Shigeru Chiba, Takasago-chi (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/715,507

(22) Filed: Nov. 19, 2003

(65) Prior Publication Data

US 2004/0100196 A1 May 27, 2004

(30) Foreign Application Priority Data

Nov. 26, 2002 (JP) ..... 2002-342185

(51) Int. Cl.[7] ..... H01J 17/18
(52) U.S. Cl. ..... 313/623; 313/624; 313/625
(58) Field of Search ..... 313/623, 624, 313/625, 626

(56) References Cited

U.S. PATENT DOCUMENTS 5,200,669 A 4/1993 Dixon et al.
6,356,018 B1 3/2002 Higashimoto et al.

*Primary Examiner*—Vip Patel
(74) *Attorney, Agent, or Firm*—Nixon Peabody LLP; David S. Safran

(57) ABSTRACT

A discharge lamp of the short arc type with high arc stability in which the arc is prevented from fluctuating during operation is achieved by providing a short arc discharge lamp in which the hermetically sealed tubes which extend from the arc tube, and the lead pins located within the arc tube which support the electrodes, are sealed relative to one another by graded glass, and wherein cylindrical retaining bodies are attached concentrically within the hermetically sealed tubes and are penetrated by the lead pins, a metal foil that has several cambers which extend in the axial direction of the lamp being located between the cylindrical retaining bodies and the lead pins.

12 Claims, 6 Drawing Sheets

DISCHARGE LAMP OF THE SHORT ARC TYPE

BACKGROUND OF THE INVENTION

1. Field of the Invention

The invention relates to discharge lamp of the short arc type which is used as the light source of a projection device and a spotlight device.

2. Description of Related Art

Conventionally, a discharge lamp of the short arc type as shown in FIG. 5 is known as the light source of a projection device such as a projector or the like. In this discharge lamp of the short arc type, hermetically sealed tubes 2 of silica glass are formed bordering the two ends of a silica glass arc tube 1. Within the arc tube 1 there is a pair of tungsten electrodes 3 which are supported by tungsten lead pins 4 which are used to supply a high current to the electrodes 3. The lead pins 4 penetrate cylindrical retaining bodies 5 of silica glass which on the inside have one through opening each and which are cylindrical. These cylindrical retaining bodies 5 are mounted within the hermetically sealed tubes 2. The lead pins 4 are sealed by graded glass 6 in the hermetically sealed tubes 2. A vessel which is insulated against the outside is filled with a gas with a high pressure as the emission substance by this hermetically sealed arrangement.

In such a discharge lamp of the short arc type, since the internal pressure of the arc tube 1 during operation becomes very high in order to increase the radiance, a construction is necessary which the hermetically sealed tubes 2 are prevented from being damaged even at a high internal pressure. Furthermore, it is necessary for the lead pins 4 which support the electrodes 3 to project directly to the outside from the hermetically sealed tubes 2 which border the arc tubes 1 since a high current is flowing in the lamps. For hermetic sealing of the hermetically sealed tubes and the lead pins 4 to one another, therefore, a hermetically sealed arrangement using graded glass 6 is used.

The process for mounting the cylindrical retaining body 5 by the hermetically sealed tubes 2 is described below.

The inside of the arc tube and the hermetically sealed tubes 2 bordering the arc tube are initially subjected to a pressure reduction to form a negative pressure state. Upon heating the outside of the respective hermetically sealed tube 2 with a torch in which the respective cylindrical retaining body 5 is located, the diameter of the hermetically sealed tube 2 is reduced in the area that is heated. As a result, the hermetically sealed tube 2 and the cylindrical retaining body 5 are welded to each another. Thus, the cylindrical retaining body 5 is mounted within the hermetically sealed tube 2.

FIG. 6 shows a cross section of the hermetically sealed tube in a plane which perpendicularly intersects the lamp axis at the position at which the cylindrical retaining body is present.

As is shown in FIG. 6, there is a situation in which the silica glass cylindrical retaining body 5 and the tungsten lead pin 4, which penetrates the inside of the cylindrical retaining body 5, are temporarily welded to one another by heating when the hermetically sealed tube 2 is welded to the cylindrical retaining body 5. Between the inside of the cylindrical retaining body 5 and the outside of the lead pin 4, there is always an extremely small intermediate space S2, present as a gap that results from the different coefficients of thermal expansion of the materials. Therefore, the interior K1 of the arc tube 1 and the interiors K2 of the hermetically sealed tubes 2, as shown in FIG. 5, are continuously connected to each other.

Furthermore, there is an arrangement in which a metal foil is clamped between the inside of the cylindrical retaining body 5 and the outside of the lead pin 4 resulting in the respective part being completely insulated. FIG. 7 shows a cross section of a hermetically sealed tube in a plane which perpendicularly intersects the lamp axis at the position at which the cylindrical retaining body is present. Between the inside of the cylindrical retaining body and the outside of the lead pin, a metal foil is clamped.

As shown in FIG. 7, when the metal foil 8 is clamped between the inside of the cylindrical retaining body 5 and the outside of the lead pin 4, there is always an extremely small intermediate space S3 formed as a gap between the inside of the cylindrical retaining body 5 and the outside of the lead pin 4. As is shown in FIG. 5, the interior K1 of the arc tube 1 and the interior K2 of the hermetically sealed tube 2 are continuously connected to one another. See Japanese Patent document JP-A HEI 11-135067 and U.S. Pat. No. 6,356,018.

Japanese utility model application HEI 04-009963 (U.S. Pat. No. 5,200,669) discloses a construction in which there are intermediate spaces S2, S3 between the inside of the cylindrical retaining body 5 and the lead pin 4 which result in the following disadvantages.

As is shown in FIG. 6, the intermediate space S2 between the inside of the cylindrical retaining body 5 and the lead pin 4 is not a uniform gap around the lead pin 4, but instead the gap is eccentric with respect to the lead pin 4. In FIG. 6, the intermediate space S2 at the top of the page of drawings is larger than at the bottom.

As is shown in FIG. 7, in the case in which there is a metal foil 8 between the inside of the cylindrical retaining body 5 and the lead pin 4, the intermediate space S3 is also not in a uniform gap around the lead pin 4, but is instead a chaotic gap, due to the metal foil 8 which comes to rest on top of itself by winding around itself or by the effect of sagging of the metal foil 8.

During lamp operation of FIG. 5, due to a discharge phenomenon or due to the high temperature of the electrodes 3, a high temperature state is present in the interior K1 of the arc tube 1. Within interior K2 gas flow is ensured due to the extremely small gap between the cylindrical retaining body 5 and the lead pin 4. That is, the gas which is present in the interior K2 of each hermetically sealed tube 2 has a lower temperature than the gas present in the interior K1 of the arc tube 1.

This means that the gas present in the interior K1 of the arc tube 1 and the gas present in the interiors K2 of the hermetically sealed tubes 2 have a temperature difference during operation. The gas within the interior K2 of each hermetically sealed tube 2 passes through the intermediate spaces S2, S3 into the interior K1 of the arc tube.

This gas flow is formed by passage through the intermediate spaces S2, S3. However, as was described above, the intermediate spaces S2, S3 are not formed around the lead pin 4 in a uniform manner, but are formed in a non-uniform manner or chaotically. Therefore, the gas flow into the arc tube 1 does not take place symmetrically around the lead pin 4. As a result, the disadvantage occurs that the gas flow within the arc tube 1 is a non-uniform flow resulting in a fluctuating, a non-stabilized arc being formed. When the arc fluctuates, especially when the light source is in a projection device, there is the disadvantage that the flicker phenomenon occurs causing the image to become bright and/or dark.

SUMMARY OF THE INVENTION

The present invention was devised to eliminate the above described disadvantages in the prior art.

Thus, a primary object of the present invention is to devise a discharge lamp of the short arc type with high arc stability in which the arc is prevented from fluctuating during operation.

This object of the invention is achieved by a short arc discharge lamp in which the hermetically sealed tubes bordering the arc tube and the lead pins supporting the electrodes located within the arc tube are sealed relative to one another by graded glass. The lead pins penetrate cylindrical glass retaining bodies which are attached coaxially within the hermetically sealed tubes. Between the cylindrical retaining bodies and the lead pins, there is a metal foil and the metal foil is formed such that several cambers extend along the axial direction of the lamp, preferably while maintaining an essentially uniform distance relative to one another.

The invention is explained in detail below using the embodiment shown in the drawings.

DETAILED DESCRIPTION OF THE INVENTION

Figure 1:
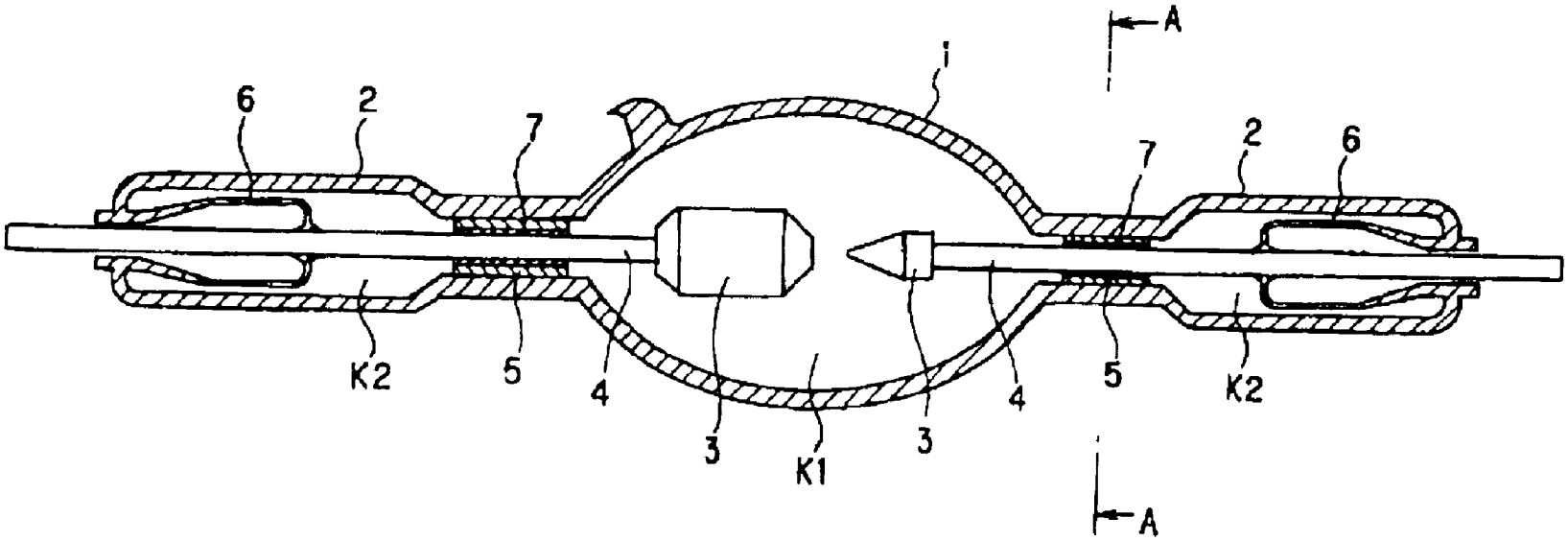
FIG. 1 shows a cross section of the arrangement of the discharge lamp of the short arc type of the invention.

In the discharge lamp of the short arc type of the invention, hermetically sealed tubes 2 of silica glass are formed bordering the two ends of a silica glass arc tube 1. Within the arc tube 1, there is a pair of tungsten electrodes 3 which are supported by tungsten lead pins 4 which penetrate the cylindrical retaining body 5 of silica glass which on the inside have one through opening each and which are cylindrical. These cylindrical retaining bodies 5 are mounted within the hermetically sealed tubes. The lead pins 4 are sealed by graded glass 6 on the hermetically sealed tubes 2. Between the respective cylindrical retaining body 5 and the respective lead pin 4 there is a molybdenum metal foil 7.

This short arc discharge lamp can be for example a xenon short arc lamp with a nominal power consumption of 10 kW. The outside diameter of the lead pin 4 is 6 mm here, the outside diameter of the cylindrical retaining body 5 is 12 mm, its inside diameter is 6.3 mm and the length in the axial direction of the lamp is 30 mm.

In this short arc discharge lamp, the inside of the arc tube 1 and of the hermetically sealed tubes 2 adjoining are subjected to a pressure reduction beforehand and placed in a negative pressure state. By heating, with a torch, the outside of the respective hermetically sealed tube 2 in which the respective cylindrical retaining body 5 is located, the diameter of the respective hermetically sealed tube 2 is reduced in the heated area. As a result, the hermetically sealed tube 2 and the cylindrical retaining body 5 are welded to one another. Thus, the cylindrical retaining body 5 is mounted within the hermetically sealed tube 2.

Figure 2:
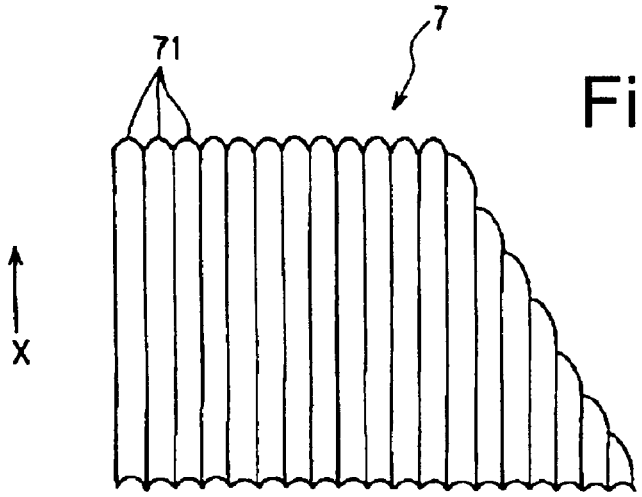
FIGS. 2(*a*) and 2(*b*) each show a schematic of only the metal foil of the discharge lamp of the short arc type of the invention.
Figure 2:
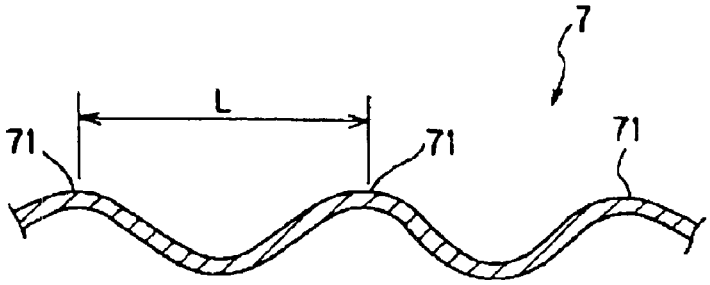

FIGS. 2(*a*) and 2(*b*) are schematics in which only the metal foil 7 is shown. FIG. 2(*a*) is an overhead view of the metal foil 7, FIG. 2(*b*) is an enlarged cross section in the direction of thickness.

The metal foil 7 is composed of molybdenum and has a thickness of 25 $\mu$m and a length in the X direction (direction of the lamp axis) of 35 mm. The metal foil 7 is formed such that several cambers 71 extend along the X direction of the lamp axis and a uniform distance L of 1 mm to adjacent cambers is maintained. In this embodiment, the metal foil 7 is corrugated. The term "camber 71" is defined as a convex upwelling on one side in the direction in which the metal foil 7 is curved around. The cambers can fundamentally have any shape. Therefore, in addition to the rounded shape, angled cambers with triangular, rectangular, trapezoidal or similar camber cross sections can be used where the cambers are repeated regularly. Rounded camber cross sections are preferred. In a particularly preferred embodiment, the cambers are the same to either side of the metal foil plane, when rounded cambers are used, they run sinusoidally.

Figure 3:
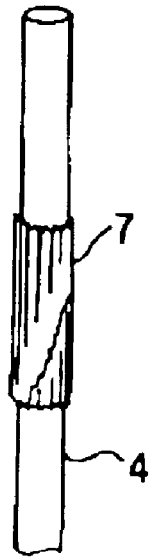
FIGS. 3(*a*) and 3(*b*) each schematically show the state in which the metal foil, the lead pin and the cylindrical retaining body of the discharge lamp of the short arc type of the invention are combined with one another.
Figure 3:
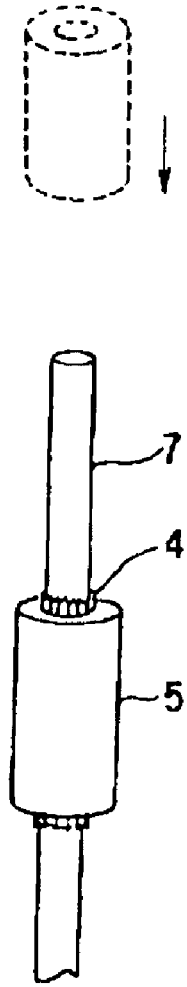

FIGS. 3(*a*) and 3(*b*) are schematics which show the embodiment in which the metal foil, the lead pin and the cylindrical retaining body are combined with one another. As shown in FIG. 3(*a*), a given site of the lead pin 4 is wound with a metal foil 7. In this embodiment part of the metal foil 7 is wound around such that the sections come to rest on top of one another. In this overlapping area, the cambers 71 come to rest on one another. In this embodiment, shown in FIG. 3(*b*), the cylindrical retaining body 5 is slipped on from the tip of the lead pin 4 so that the metal foil 7 is located between the lead pin 4 and the cylindrical retaining body 5.

Figure 4:
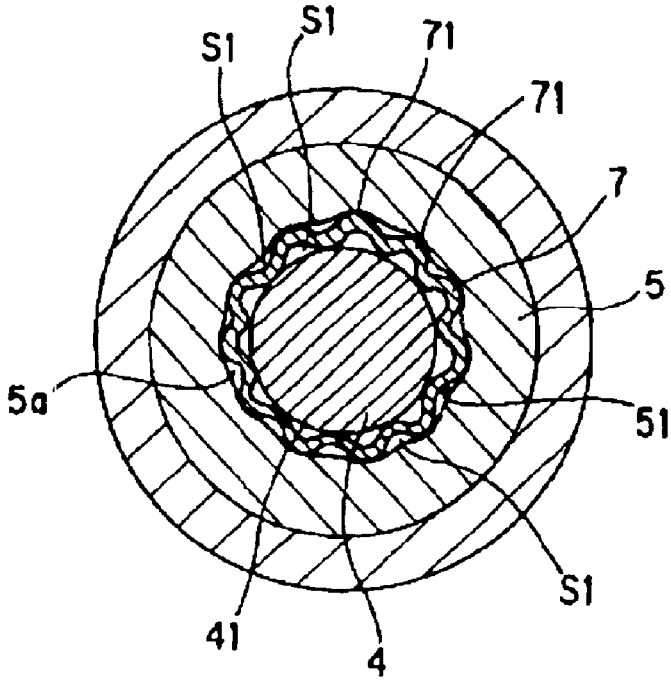
FIG. 4 is a cross-sectional view of the hermetically sealed tube taken along line A—A in FIG. 1 in the direction of the arrows at a location at which the cylindrical retaining body is present.
Figure 5:
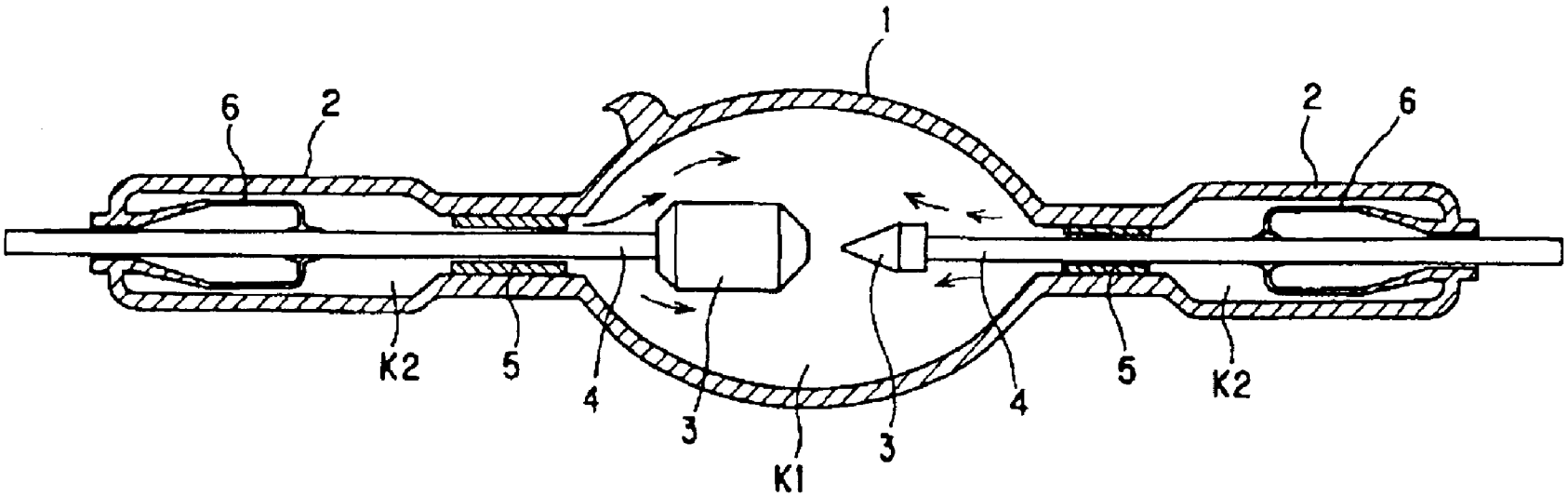
Fig. 5 (Prior Art)
FIG. 5 is a longitudinal cross-sectional view of the arrangement of a conventional discharge lamp of the short arc type.
Figure 6:
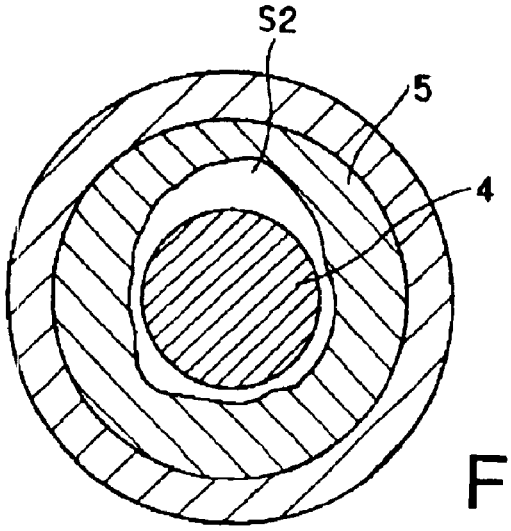
Fig. 6 (Prior Art)
FIG. 6 is a transverse cross-sectional view of the hermetically sealed tube at the position at which the cylindrical retaining body of a conventional discharge lamp of the short arc type is present.
Figure 7:
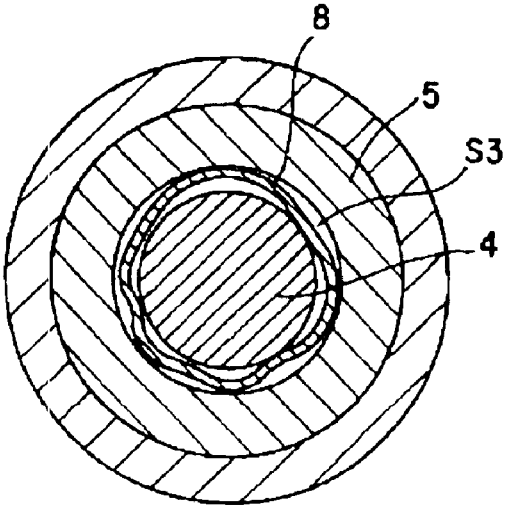
Fig. 7 (Prior Art)
FIG. 7 illustrates a cross section of the hermetically sealed tube transverse at the position at which the cylindrical retaining body of a conventional discharge lamp of the short arc type is present.

FIG. 4 is a cross section of the hermetically sealed tube along section line A—A of FIG. 1 orthogonally intersecting the lamp axis at the position at which the cylindrical retaining body is present.

As is shown in FIG. 4, there is a metal foil 7 between the inside 51 of the cylindrical retaining body 5 and the outside 41 of the lead pin 4. Since this metal foil 7, as described above, is made such that several cambers 71 extend along the axial direction of the lamp while maintaining the same distance to one another, when heating to form a welding attachment of the cylindrical retaining body 5 to the hermetically sealed tube 2, the hermetically sealed tube 2 and the lead pin 4 is wound with the metal foil 7. The cambers 71 project radially with the same distance relative to one another around the lead pin 4 and act as a buffer component. Even if the inside 51 of the cylindrical retaining body 5 melts and deforms in the direction of the lead pin 4, this state of deformation can be made essentially uniform around the lead pin 4. Furthermore, the lead pin 4 can be positioned in the center of the through opening 5*a* of the cylindrical retaining body 5.

As a result, the gap between the inside 51 of the cylindrical retaining body 5 and the outside 41 of the lead pin 4 is divided by the metal foil into several gaps with an essentially identical size. The intermediate spaces S1 formed by this division are present as gaps around the lead pin 4 in an essentially uniform state.

As is shown in FIG. 1, the interior K1 of the arc tube 1 and the interior K2 of the hermetically sealed tube 2 are continuously connected to one another. Even if the gas flows through the intermediate spaces S1 within the interior K2 of the hermetically sealed tube 2 and even if a gas flow arises that is flowing in the direction of the interior K1 of the arc tube, this gas flow takes place symmetrically to the lead pin 4, thereby reliably preventing the arc fluctuation.

Furthermore, the gap between the inside 51 of the cylindrical retaining body 5 and the outside 41 of the lead pin 4 is divided into several parts and the size of the intermediate space S1 formed by the division is reduced. Therefore, the flow velocity of the gas flowing in these intermediate spaces S1 is reduced by contact with the large-area surface of the metal foil 7, the inside 51 of the cylindrical retaining body 5 and the outside 41 of the lead pin 4. The result is that arc fluctuation is reliably prevented.

As was described above, according to the short arc discharge lamp of the invention, between the cylindrical retaining bodies which are weld mounted on the insides of the hermetically sealed tubes and the lead pins which penetrate the insides of this cylindrical retaining body, there are metal foils. These metal foils are formed such that several cambers extend in the axial direction of the lamp while maintaining an essentially identical distance to one another. Even if a gas flow arises in which the gas is flowing through the intermediate spaces into the interiors of the hermetically sealed tubes, spaces are formed between the cylindrical retaining bodies and the lead pins and in the direction of the interior of the arc tube, this gas flow is formed symmetrically to the lead pins. Furthermore, the intermediate spaces hinder the gas flow thereby reducing the flow velocity. Therefore fluctuation of the arc can be reliably prevented and a short arc discharge lamp with high arc stability is obtained.

What is claimed is:

1. A short arc discharge lamp comprising:

an arc tube, hermetically sealed tubes which extend from the arc tube, electrodes located within the arc tube, lead pins supporting the electrodes and sealed within the hermetically sealed tubes by graded glass, said lead pins penetrating cylindrical retaining bodies which are made of glass and are attached concentrically within the hermetically sealed tubes, and a metal foil positioned between each glass cylindrical retaining body and each lead pin surrounding each of said pin, wherein the metal foil has a plurality of uniform cambers which extend in an axial direction of the lamp.

2. The short arc discharge lamp as claimed in claim 1, wherein the cambers are located at essentially the same distance relative to one another.

3. The short arc discharge lamp as claimed in claim 1, wherein the cambers extend over the entire length of the metal foil.

4. The short arc discharge lamp as claimed in claim 1, wherein the cambers have essentially the same shape.

5. The short arc discharge lamp as claimed in claim 4, wherein the cambers project on both sides of a center plane of the metal foil with essentially the same shape and size on each side of the center plane.

6. The short arc discharge lamp as claimed in claim 5, wherein the cambers have a sinusoidal cross section.

7. The short arc discharge lamp as claimed in claim 1, wherein the metal foil is wound around the lead pin such that the metal foil surrounds the lead pin in at least one layer.

8. The short arc discharge lamp as claimed in claim 7, wherein the metal foil is wound around the lead pin such that sections of the metal foil come to rest on each other.

9. The short arc discharge lamp as claimed in claim 1, wherein the metal foil is constructed such the intermediate spaces bordered by the cambers have an essentially identical opening cross section.

10. The short arc discharge lamp as claimed in claim 1, wherein the metal foil is composed of molybdenum.

11. The short arc discharge lamp as claimed in claim 1, wherein the metal foil has a sinusoidal configuration which runs in a circumferential direction about the lead pins.

12. The short arc discharge lamp as claimed in claim 1, wherein the cambers of the metal foil define a series of axially extending gaps of uniform cross-sectional area.

* * * * *